United States Patent [19]

Warehime

[11] 4,330,131

[45] May 18, 1982

[54] MULTI-TETHERED BALL ASSEMBLAGES AND THEIR USES

[76] Inventor: Norwood R. Warehime, 704 W. 34th St., Baltimore, Md. 21211

[21] Appl. No.: 191,083

[22] Filed: Sep. 26, 1980

[51] Int. Cl.[3] ..... A63B 67/00

[52] U.S. Cl. ..... 273/413

[58] Field of Search ..... 273/413, 414, 58 C

[56] References Cited

U.S. PATENT DOCUMENTS

| | | | |
|---|---|---|---|
| 124,915 | 3/1872 | Rix | 273/413 |
| 2,496,795 | 2/1950 | Johnson | 273/413 |
| 3,509,660 | 5/1970 | Seymour | 273/414 X |
| 3,901,505 | 8/1975 | Gerechter | 273/414 X |
| 3,953,029 | 4/1976 | Boyd | 273/413 |
| 4,095,787 | 6/1978 | Saferstein | 273/413 |

*Primary Examiner*—William H. Grieb

[57] ABSTRACT

Multi-tethered ball assemblages, each using 3 to 12 standard tethered balls, with connecting lines from 10 to 20 feet (3 to 6 mts) long, are attached to a freely positioned central hub ring. Connecting lines have swivels and spring fasteners to prevent lines from twisting and to facilitate easy attachment of lines to balls and hub. Decorative items such as flags, ribbons, and banners can be attached to connecting lines for added visual effect. Hub is small metal ring about 2 inches (5.2 cms) in diameter. Multi-tethered ball assemblages can be used in group participation for recreation, exercise, display, and synchronous ballet activities by tossing, tapping, rolling, bouncing, and passing tethered balls from person-to-person in a large horizontal circular pattern about central hub, with circular pattern radius being determined by taut connecting line length, and with all said activities being carried out on signals or count, or in time with music. Groups numbering from 6 to 30 persons or more can use assemblage indoors, outdoors, in water, in parades, etc.

6 Claims, 3 Drawing Figures

FIG. 1
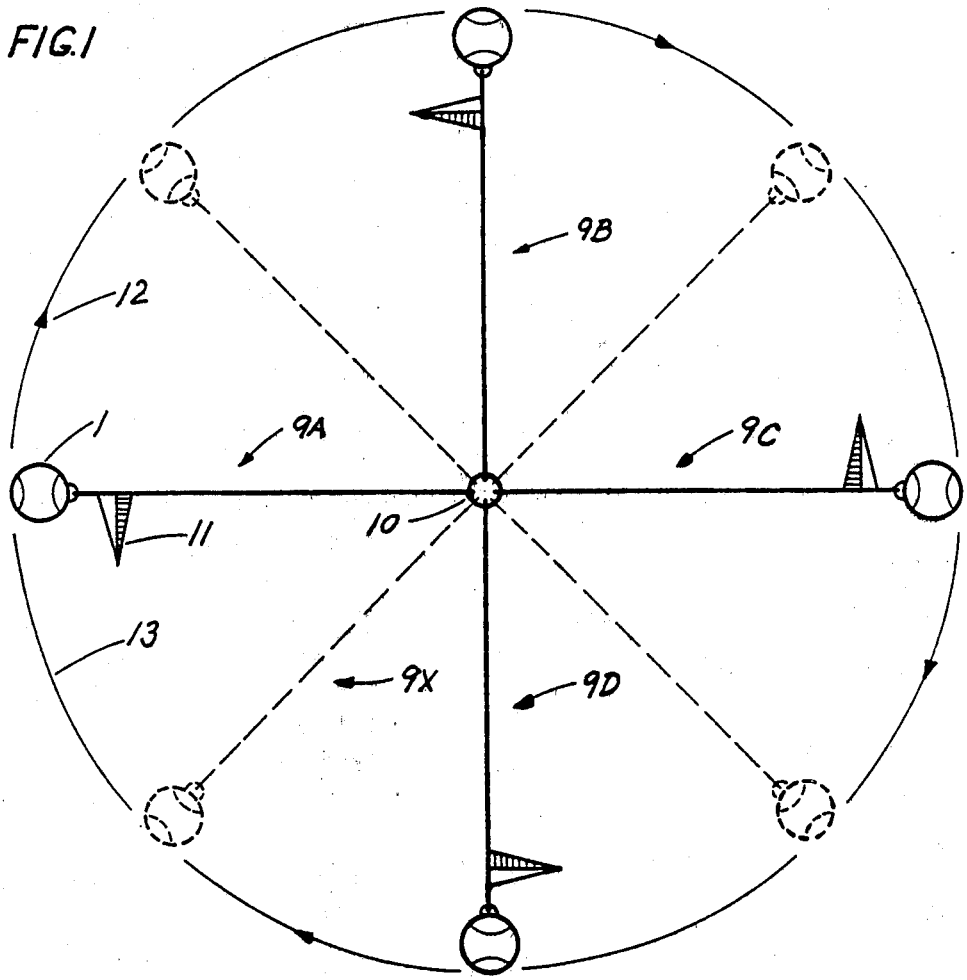
FIG. 2
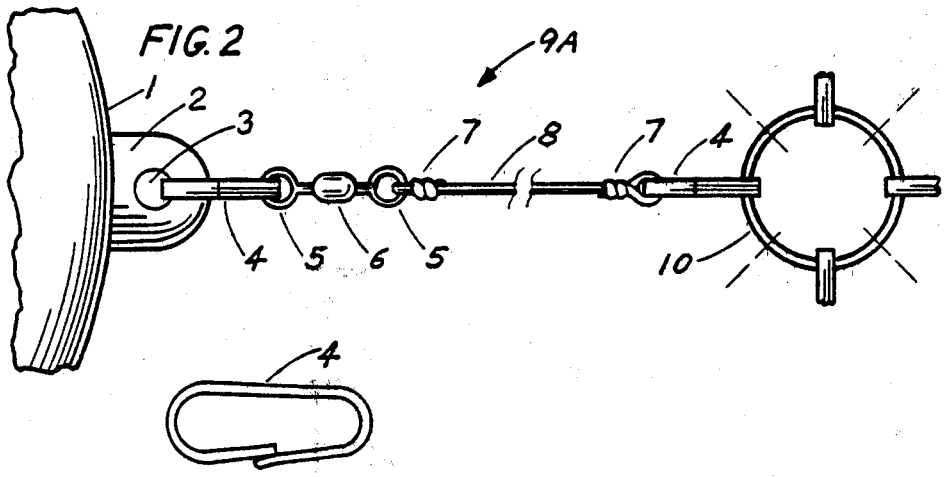
FIG. 3

MULTI-TETHERED BALL ASSEMBLAGES AND THEIR USES

TECHNICAL FIELD

The invention relates to multi-tethered ball assemblages and their uses; a plurality of standard or lightweight tethered balls, with flexible connecting lines and fittings, are attached to a small freely positioned central hub ring. Assembly of 3 to 12 balls, with from 10 to 20 feet (3 to 6 mts) long connecting lines, can be used by 6 to 30 persons in group action recreation, exercise, display, synchronous ballet, and other maneuvers. Balls can be rotated about hub in air by tossing them person-to-person in a large horizontal circular motion pattern, can be bounced, can be reserved in motion on signal, can be thrown high in air, can be rolled on floor or ground, etc. Balls are also suitable for use in water. Decorative items can be attached to connecting lines for display effect.

BACKGROUND ART

No related patents or other documents have been noted using a plurality of tethered balls with lines attached to a freely positioned central hub. Most tethered balls used today are of the single ball and line type. Some tethered balls of small size diameter are used in a paired tethered manner, but no central hubs are used. No tethered ball assemblages for use in sports or recreation, with 3 or more balls, have been noted in prior art using a freely positioned central hub ring.

DISCLOSURE OF INVENTION

The invention as claimed is intended to provide an assembled multiplicity of tethered balls, with connecting lines and fittings, attached to a small freely positioned central hub ring. It solves the problems of: (a) how to design multi-tethered ball assemblages which can be used in group activities; (b) how to readily change variables in assemblages; (c) how to prevent twisting and fouling of connecting lines; (d) how to use assemblages; (e) how to add decorative items to assemblages.

The advantages offered by the invention are mainly that a multi-tethered ball assemblage can be made using standard or lightweight tethered balls, spring fasteners, swivels, flexible connecting lines, and a small central hub ring which receives all connecting lines. Balls and connecting lines can readily be added to or removed from assemblages by use of spring fasteners at hub ring. Ball sizes and line lengths can readily be changed as needed to suit types of participants.

Small swivels are inserted and secured in connecting lines to prevent lines from twisting while in use. Also, it is suggested that lines be wound on reels provided to prevent lines from becoming fouled and tangled while not in use. Multi-tethered ball assemblages can be used in a wide variety of recreation, exercise, display, synchronous ballet, water sports activities, and other group programs. Decorative colored balls, flags, ribbons, banners, etc. can be tied or fastened to assemblages for added visual effect. In general, multi-tethered ball assemblages are safe, inexpensive on group use basis, can be used indoors, outdoors, in parades, in water, and can be a new, effective tool in the recreational and sport fields.

BRIEF DESCRIPTION OF DRAWINGS

For further elucidation of the invention, a preferred embodiment thereof will now be described with reference to the accompanying drawings, in which:

FIG. 1 is a schematic view from above showing four tethered balls and lines in assemblage, with four optionally positioned additional balls and lines, all attached to a central hub ring. Added decorative flags are also shown.

FIG. 2 is top detail showing ball, fasteners, swivel, line, and central hub ring.

FIG. 3 is an enlarged view of fastener used to attach both the ball and hub ring to the connecting line.

DESCRIPTION OF PREFERRED EMBODIMENT

Referring to FIG. 1, one tethered ball and connecting portion of a complete assemblage, with fittings and a decorative flag, is generally indicated by 9A. Three other identical ball-line portions are generally indicated by 9B, 9C, and 9D. Four optional ball-line additional portions are indicated by dashed lines and referred to as 9X. Central hub ring 10 holds all ball-line portions of assemblage. Decorative flag 11 is attached to line of 9A. Flags are also shown on other ball-line portions. As shown, the complete assemblage is generally in a horizontal plane with all lines stretched outwardly from hub ring 10 at center. Balls and lines can be on floor or ground and are ready for use. The number of participants for use of a four ball assemblage as shown can range from 8 to 24 persons or more. Participants form a circle around perimeter of balls as indicated by 13, and properly spaced participants pick-up balls and hold them in their hands and prepare for action. On signal, or on count, or in time with music, participants can, as a basic movement, toss balls to neighbors in a direction as indicated by arrow 12 on perimeter 13. Balls can also be passed on to every second or third participant or so, can be tapped by hand in a circular pattern, can be thrown high in air, can be rolled or bounced on floor or ground, etc., all in a proper timing sequence. Ball movement can be reversed on signal, can be tossed back and forth across circle, while still in a general overall circular rotational pattern of the assemblage. Speed of ball movement can be varied as desired. The assemblage as shown can also be used in water for water ballet and synchronous swimming activities. A simple inflated plastic or rubber float ring might be used to hold the central hub ring on the water surface if so desired.

FIG. 2 of drawings shows details of a representative ball-line portion of an assemblage, wherein the tethered ball 1 has an ear lug 2 with hole 3 to receive spring fastener 4. The same fastener 4 also connects to swivel eyelet 5 attached to swivel body 6. The second swivel eyelet 5 receives flexible line 8 with knot tie 7. Other end of line 8 ties to second spring fastener 4 attached also to hub ring 10. FIG. 3 shows detail of spring fastener 4.

Materials and items for a multi-tethered ball assemblage are readily available. Balls, of rubber or plastic, should be lively, and range from a junior size of about 6 inches (15.2 cms) diameter and weight of about 4 ounces (114 gms) to an adult size of about 9 inches (22.9 cms) diameter and weight of about 12 ounces (341 gms). Spring fasteners and swivels are standard hardware items. Connecting lines should be strong, colored nylon braid. Varied colors of lines are suggested because in case of tangled lines, the colors make untangling of lines an easier job. Varied lengths of lines can be used to suit use and participant requirements. Simple reels might be considered to hold lines while not in use to prevent tangling, especially if many lines are involved. The central hub ring can be a simple metal ring about 2 inches (5.1 cms) diameter with a cross sectional thickness of about 150 inches (3.5 mms). Decorative items can be varied to suit use and occasion. The number of balls and lines for an assemblage can also be varied to suit use and occasion, but it should be remembered that the more balls used in an assemblage, the stabler the ball movement is in the horizontal circular pattern. Even if one or two balls are missed momentarily in handling, the rest of the balls in the horizontal rotation will maintain a steady and stable pattern if handled properly. To assist in practice use of an assemblage, a post or standard about 2 yards (2 mts) high can be used to support central hub ring 10 using an improvised pivot means. In handling of tethered balls in a horizontal circular pattern, it should be remembered that a small outward vector force from central hub tends to keep connecting lines taut and balls moving in a smooth path.

Subject invention may be embodied in other specific forms without departing from the spirit or essential attributes thereof and, accordingly, reference should be made to attached claims, rather than to the foregoing description as indicating the scope of the invention.

I claim:

1. Multi-tethered ball assemblages and their uses wherein said assemblages each comprises a plurality of standard type tethered balls attached to a freely positioned central hub means by use of substantially identical flexible connecting lines, said lines having swivel means and fastening means therein to form continuous linkage between said balls and said central hub means, with a small outward vector force from said central hub means tending to keep said connecting lines taut and said balls moving in a smooth path when said balls are handled in a horizontal circular pattern in group participation by tossing, tapping, rolling, bouncing, and passing said balls from person-to-person.

2. Multi-tethered ball assemblages and their uses according to claim 1 wherein said balls are from 5 inches (12.7 cms) to 12 inches (30.5 cms) in diameter.

3. Multi-tethered ball assemblages and their uses according to claim 1 wherein said balls number in count of 3 or more.

4. Multi-tethered ball assemblages and their uses according to claim 1 wherein said connecting lines are all each 10 feet (3 mts) to 20 feet (6 mts) in length.

5. Multi-tethered ball assemblages and their uses according to claim 1 wherein said connecting lines have decorative items attached thereto for visual effects.

6. Multi-tethered ball assemblages and their uses according to claim 1 wherein said central hub means is a circular ring.

* * * * *